US007785240B2

(12) United States Patent
Stugart

(10) Patent No.: US 7,785,240 B2
(45) Date of Patent: Aug. 31, 2010

(54) WEIGHTED EXERCISE RING AND SYSTEM

(76) Inventor: JoAnne Rose Stugart, 5130 Double Bridges Rd., Meherrin, VA (US) 23954

( * ) Notice: Subject to any disclaimer, the term of this patent is extended or adjusted under 35 U.S.C. 154(b) by 0 days.

(21) Appl. No.: 12/660,416

(22) Filed: Feb. 27, 2010

(65) Prior Publication Data

US 2010/0160123 A1 Jun. 24, 2010

Related U.S. Application Data

(63) Continuation-in-part of application No. 12/229,697, filed on Aug. 26, 2008, now abandoned.

(60) Provisional application No. 60/972,323, filed on Sep. 14, 2007.

(51) Int. Cl.
*A63B 21/072* (2006.01)
*A63B 23/16* (2006.01)
*A63B 21/06* (2006.01)

(52) U.S. Cl. ..... 482/108; 482/50; 482/93

(58) Field of Classification Search ..... 482/44–50, 482/92, 93, 106, 108; 446/26–28, 40, 69, 446/236

See application file for complete search history.

(56) References Cited

U.S. PATENT DOCUMENTS 3,246,424 A * 4/1966 Gregory ..... 446/40
4,029,312 A * 6/1977 Wright ..... 482/108
D274,283 S * 6/1984 Wright ..... D21/682
4,632,391 A * 12/1986 Orak ..... 482/110
4,685,667 A * 8/1987 McDonald ..... 482/111
4,854,575 A * 8/1989 Wilson et al. ..... 482/108
D343,660 S * 1/1994 Hwang ..... D21/682
5,509,877 A * 4/1996 Adams ..... 482/108
5,674,162 A * 10/1997 Ellingson et al. ..... 482/110
5,692,944 A * 12/1997 Pellicone ..... 446/170
5,692,996 A * 12/1997 Widerman ..... 492/93
5,741,206 A * 4/1998 Anastasi ..... 482/105
5,857,946 A * 1/1999 Brown ..... 482/108
6,364,734 B1 * 4/2002 Ng ..... 446/236
6,461,282 B1 * 10/2002 Fenelon ..... 482/106
D480,438 S * 10/2003 Walkow ..... D21/681
2007/0184943 A1 * 8/2007 Davies ..... 482/93
2009/0075792 A1 * 3/2009 Stugart ..... 482/93

* cited by examiner

*Primary Examiner*—Loan Thanh
*Assistant Examiner*—Allana Lewin
(74) *Attorney, Agent, or Firm*—Bradley D. Goldizen

(57) ABSTRACT

A circularly shaped weight includes an opening in the center having a handle extending there through. The handle bi-sects the opening and creates equal openings for receiving a hand or foot of the user. The weight is particularly useful for individuals who may be incapacitated by arthritis or other physical ailments that may prevent them from properly grasping a weight. The novel shape is useful in stacking the weights when they are not in use. A plurality of circularly shaped weight may be fastened together via a coupler.

11 Claims, 19 Drawing Sheets

WEIGHTED EXERCISE RING AND SYSTEM

The present application relates to U.S. Provisional Patent Application Ser. No. 60/972,323 filed on Sep. 14, 2007 and is a Continuation-in-Part application to U.S. patent application Ser. No. 12/229,697 filed on Aug. 26, 2008 now abandoned and claims priority therefrom.

The present application did not receive any federal research and/or development funding.

TECHNICAL FIELD

Generally, the present invention relates to a weighted exercise ring for exercising the muscles of the body such as the arms and legs. More specifically, the invention is a "free weight" system that includes a plurality of circular rings that are attached together to create an overall larger weight via at least one quick connect/disconnect coupler. The term "free weight" describes a weight-lifting device that may be used for a plurality of exercises and whose motion is not constrained by an external apparatus. This term "free weight" as used throughout the application indicates that the weighted exercise ring includes a handle and ring surface, either of which may be grasped by a user. No other implements, bars, or weight lifting devices are necessary in practicing the invention and the associated exercises. A centrally located handle extends across the entire diameter of the opening to bisect the ring of material into equal halves to create symmetrical halves. The ring of material is preferably metal or other material coated in a plastic or rubber material. Otherwise, the weights may be formed from a hollow plastic ring and include an opening through which shot, sand, water or other material may be deposited. Thereafter, a cap or cover seals the opening to prevent the material from leaking out. The system includes a plurality of different sized rings of various diameters. The invention is useful in practicing physical fitness and for rehabilitation of injured individuals. The device is particularly useful for individuals with hand or wrist injuries, as the devices can be arranged around the wrist to work the upper arms or easily grasped.

BACKGROUND OF THE INVENTION

Due to physical fitness and rehabilitation concerns, public demand for new and improved exercise devices continues to grow. After being injured, many Americans undertake rehabilitation that includes physical therapy requiring the patient to perform various muscle strengthening exercises to speed the recovery process. Physical fitness has been shown to improve the overall quality of life. Thus, many individuals practice physical fitness or therapy routines that include the use of weight machines and free weights.

Conventional weights are used with weightlifting devices such as dumbbells and barbells. The conventional weights are flat and disc-shaped. Each includes a small central opening for mounting the weight onto a weight lifting device such as a dumbbell or barbell. The central opening of each weight is uniform in size regardless of the size of the weight. A weight is mounted on opposite ends of a bar and fastened to the bar via a collar that slips over an end of the bar. Typically, the weights have sharp edges on each side of their outer diameter.

Conventional weights are difficult to grasp with the hand and use as an independent exercise implement. Moreover, it is impossible to use these weights when working out the leg muscles without coupling them to a weightlifting device. These conventional weights are difficult to hold because the overall diameter of the central opening is typically one inch (1") or smaller. Thus, these weights tend to slip out of the user's hand when mounting them onto an end of the barbell or dumbbell. The weights must be grasped by the flat planar surfaces or edges when mounting them. Therefore, it is virtually impossible to easily use conventional weights alone as an exercise implement. Indeed, many injuries are caused by dropping a conventional weight on a foot or hand of the weight lifter.

Conventional weights are stored on a weight tree having tubular extensions extending from a reinforced structure. The size and shape ofo conventional weights prohibits them from being stored in a stacked manner and easily used. The shape of the weights and sharp edges of the weights tend to pinch fingers of the user if the weights are stacked atop one another. Moreover, sliding the weights against one another tends to cause premature wear and damage to the weights. Further, the largest weight is very difficult to lift from the floor when it is laid flat upon the floor.

Thus, the use of a conventional weight as an exercise implement without a weightlifting device can be dangerous if the weight slips out of one's hand, and may cause harm to the user or damage to nearby property.

It is an aim of the invention to provide a weight having a novel shape and particularly suited for overcoming drawbacks associated with conventional weights and the inability of a user to effectively practice physical therapy or conditioning without the aid of a weight lifting device such as a bar.

SUMMARY OF THE INVENTION

The invention is a hand held weight or exercise ring that can be comfortably grasped in with one hand or with two hands. It is very useful by persons who experience problems with grasping a conventional weight. The hand held device distributes weight over a large area and may be safely held and used in a variety of manners. For example, the weight may be grasped along a portion of the exterior ring or the interior handle. Moreover, the weight may be grasped like an automobile steering wheel and used with two hands arranged at comfortable areas on an exterior thereof. For those incapacitated with arthritis in their hands or fingers, the device may be balanced about the wrist and used to work the upper arm muscles. Likewise, the device may be balanced on a user's foot and used to work the front and back muscles of the legs and feet. Similarly, the user may perform abdominal muscle strengthening exercises with the novel weight.

As can be understood by reading the following disclosure, the torque and weight experienced by the user can be varied by changing the position in which the device is grasped, by one or both of the hands. That is, the moment experience about a point on the weight changes as the weight is held in a different manner. Thus, the weight experienced by the user may simply be increased or decreased by holding the device in a different manner. This ability to change the torque and weight experienced by the user, advantageously enables the user in exercising different muscles, joints and ligament groups to aid in strengthening and flexing them.

In the preferred embodiment, the invention is a ring, having a diameter formed from metal and including a rubberized coating or exterior material that dampens the weight when dropped. A cross section of the ring is preferably circular in shape. It should be recognized that the shape of the cross section of the ring may be other geometric shapes. The exterior surface of the ring and handle is comfortable to grip and thermally insulating such that cold temperatures from the metal, or from weighted material inside the ring and/or handle are not transferred to the flesh of the user during exercise sessions. Similarly, many of these unique features are present in the second embodiment of the invention where at least the ring of the weight is hollow and filled with a material through an opening. A cover is arranged across the opening to seal it. The exterior surface of the second embodiment may be thermally insulating such that cold temperatures from within the exercise ring are not transferred to the flesh of the user.

The exercise ring is a free weight that may be grasped with the user's hands arranged on the ring to perform weight, aerobic, or stretching exercises. Those with ailments who cannot grasp the weight, can hold the weight loosely within the palms of their hands. Alternatively, they may rest the weight in the palms of their hands and stabilize it with their thumbs. Otherwise, the weight may be held between the hand and thumb.

A plurality of rings can be coupled together to increase the overall weight used. In a preferred use, multiple weights are coupled together via couplers that quickly secure two or more weights together. Strips of flexible material includes a fastener having overlapping ends such that a first weight is laid onto the floor and a second weight is arranged atop the first weight and coupled thereto via the flexible coupler. Thereafter, the increased weight may be easily picked from the floor and used during an exercise routine. The couplers are preferably hook and loop fasteners. The size of the rings allow up to three or four weights to be coupled together and used.

The exercise ring is a weight that can be held with one hand for weight work using the ring. It may be held vertically or horizontally on either side of the handle or at the junction where the handle intersects the ring. Alternatively, the ring can be grasped along the ring similar to a steering wheel. As can be recognized, the weight experienced by the user may be increased by simply changing the grip. Thus, a user can perform a first repetition of an exercise by grasping the central region of the handle. Thereafter, grasping the ring of the weight will change the magnitude of weight experienced by creating a moment arm that extends across the ring of the weight. One unique characteristic of the instant invention is the equal distribution of weight over the ring when grasped in the central region of the weight.

Increasing the cross section diameter of the material comprising the ring or, increasing the diameter of an internal opening defined by the ring, increases the overall size of each weight. The cross section diameter of the handle and ring is preferably kept between one-half an inch and one inch (0.5"-1.0") for ease in holding and using the exercise ring and coupling it to other exercise rings. The unique shape of the weight allows for easy storage. For instance, a plurality of exercise rings may be stacked on one another, hung from a wall hook, placed flat in drawers or easily packed in a suitcase for use while traveling.

In the preferred system, four different sized exercise rings are provided. However, it is contemplated that the quantity of the exercise rings used in the system may vary from less than four to more than four weights. In the preferred embodiment, the weights of the system can be coupled together to create a desired weight up to thirteen pounds. The smallest weight is preferably two pounds. The ring material of the weight may be a shell which defines an internal hollow compartment to include an access opening with a cover, as shown in FIGS. 1C-1D. In this manner, the empty compartment is filled with other materials such as shot, water or sand. Providing the weights with empty compartments reduces the shipping costs and saves on an overall cost of providing the system to a user.

It is therefore an object of the present invention to provide an improved weight and weight system used for practicing physical fitness and physical therapy. The system comprises a plurality of exercise rings having a handle bisecting each ring. The rings are capable of being coupled together via one or more straps that are wrapped about the handles to bind them together.

It is an object of the invention to be able to strengthen muscles that rotate a hand or lower arm of a user by grasping the handle of a weight and, in one instance, arranging the user's hand within the circular ring that forms the weight to rotate the hand in a clockwise and counterclockwise manner. It is another object of the invention to provide a weight that allows multiple muscle strengthening exercises which cannot be performed with conventional weights. The multiple muscle strengthening exercises include exercises that require use of the hand to grasp the weight by inserting at least the user's fingers into the opening defined by the ring of the weight.

It is another object of the invention to provide a weight that may be securely held by a single human hand or by both hands on opposite sides of the ring that defines the weight by inserting the user's fingers into the opening of the weight bisected by the handle.

It is an additional object of the invention to provide a system of free weights that may be stacked atop one another on a floor for storage purposes and thereafter easily removing one from another without fear of injury to oneself.

It is another object of the invention to teach a weight system comprising free weights that may be easily stored by fastened the weights together and hanging them from a conventional wall hook that will sustain at least fifty (50) pounds.

It is a further object of the invention to provide a weight that has an integrally-formed gripping means. The gripping means includes a handle for use with a single hand and a pair of equal circular halves arranged on either side of the handle such that the weight can be gripped for use with either a single hand or both hands.

These and other objects and advantages of the invention will be set forth, appear in part or become apparent after considering the specification and accompanying drawings. It is to be realized that the following embodiments of the invention have been represented in their simplest form for ease in understanding the invention.

BRIEF DESCRIPTION OF THE DRAWINGS

In FIG. 6A, the exercise ring or weight is held by the ring portion and the handle is arranged parallel to the arms of the user.

DETAILED DESCRIPTION OF THE INVENTION

Figure 1A:
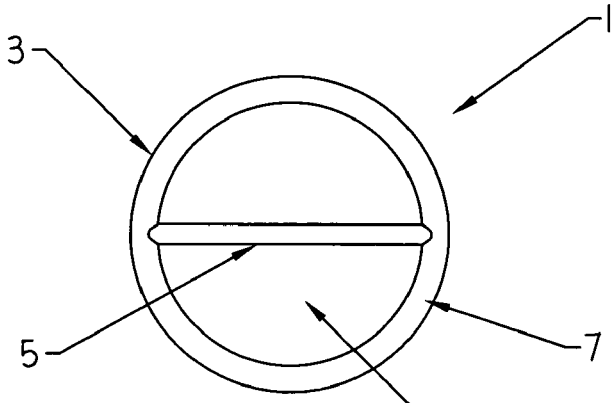
FIG. 1A is a perspective view of a preferred embodiment of the invention and showing a single exercise ring or weight.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

The exercise rings or weights can be provided with variations in thickness, overall size or by changing the circular ring into an oval or other geometric shape. In the preferred embodiment of the system, four weighted exercise rings are provided. The interior diameter created by the ring of the smallest weight is six inches. The interior diameter of the ring of the largest weight is twelve inches. Thus, the interior diameters of the weighted exercise rings are in a range that varies between six and twelve inches. The second smallest weight has an interior diameter of nine inches. The second largest weight has an interior diameter of ten inches. The weight of each exercise ring in the system is measured in pounds and is preferably 1.4 lb., 3.2 lb., 5.2 lb., and 8.0 lb. Thus, the weight of each exercise rings varies from a range substantially near one pound to substantially eight pounds.

The invention is great for use by those with disabilities such as arthritis or injuries to the wrist, elbow, shoulder, ankle, knee or other joint problems. Athletes can use the invention to focus on specific areas. For example, the device may be used by baseball players in gaining strength for swinging a bat, pitching or strengthening their wrists. Golfers can use the weights for practicing swings. Hockey players can increase wrist development. Tennis players can increase their strikes. Physical therapists find the device useful in rehabilitating wrists, elbows, shoulders, ankles, knees or other joints, muscles or ligaments. Runners can carry the weights during running exercises.

Figure 1B:
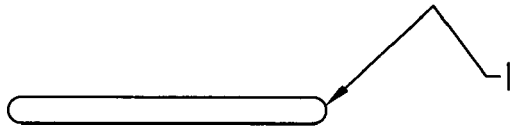
FIG. 1B is a side view of the invention.

FIGS. 1A and 1B show a single exercise ring or weight 1 that comprises an outer ring 3 defining an internal opening 4. An inner grip 5 bisects the outer ring 3 to divide the internal opening 4 into preferably equal sections as shown. The equal sections are symmetrical to one another to provide for stability during weight training exercises.

A cross section diameter of the inner grip 5 is preferably smaller than a cross section diameter of the outer ring 3. This aids in picking up the exercise rings or weights 1 when stacked atop one another or on a floor. The outer ring 3 may comprise a container 30 that is filled with a weighty material such as lead or steel shot, water, sand etc. In the preferred embodiment, a rubberized coating 7 or exterior material is comfortable to the grip and thermally insulates the user's skin from the weight 1. In this manner, the weight can be used in cold temperatures without transferring uncomfortable temperatures to the flesh of the user during exercise sessions. In certain instances, a solid metal weight without an exterior coating may be useful for those suffering arthritic pain during the workout process since the weight can be chilled to cooler temperatures and used to sooth the hands or feet.

Figure 1C:
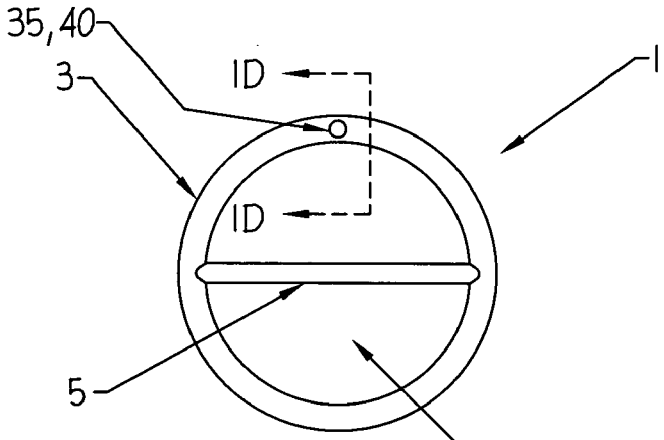
FIG. 1C is a second embodiment of the invention wherein at least the exterior ring of the weight is a hollow shell. An opening is included in the hollow shell for providing access to the interior thereof. The opening is covered with a cap during use.
Figure 1D:
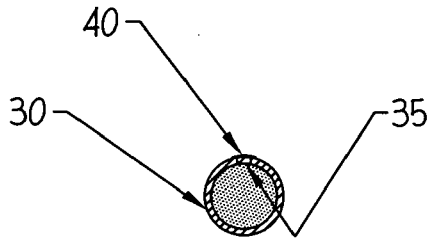
FIG. 1D is a cross section view of FIG. 1C taken from line 1D-1D.

In FIGS. 1C and 1D, the weighted exercise ring 1 includes at least a hollow shell or container 30 having an opening 35 that is sealed by cover 40. Sand, shot, water or other such material may be deposited into the container 30 through opening 35. The deposited material is then sealed into the container 30 by cover 40.

Figure 2A:
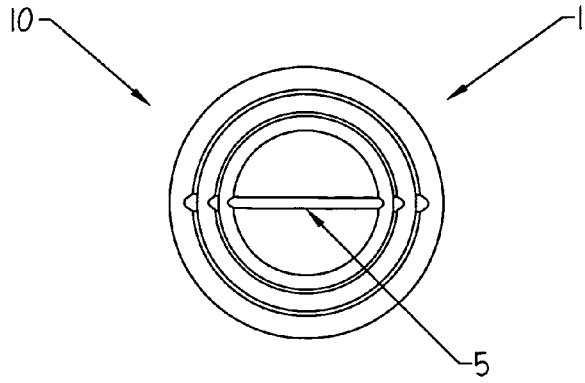
FIG. 2A shows a system of three exercise rings having different sized openings formed by the outer rings thereof and being stacked atop one another for storage.
Figure 2B:
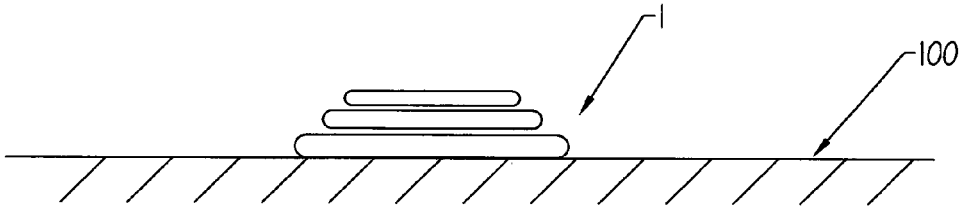
FIG. 2B is a side view of the three exercise rings arranged on a floor.

FIGS. 2A and 2B show a system of three exercise rings or weights having different sized openings formed by the outer rings of the weights and being stacked atop one another for storage. In a preferred embodiment, the system 10 includes four exercise rings or weights having different inner diameters of the outer ring.

The smallest weighted exercise ring has a six inch inner diameter with a three inch radius. This smallest weight has a circumference at an inside radius of one foot and six and seven-eighths inches. The cross sectional diameter of the outer ring is substantially one-half an inch. The cross sectional diameter of the grip may be under one-half an inch.

The outer ring of the next larger exercise ring in size defines a nine inch inner opening with a radius of four and one-half inches. The cross sectional diameter of the outer ring and the grip are substantially five-eighths an inch. This exercise ring has a circumference at an inside radius of two feet and four and one-quarter inches.

The next largest exercise ring in size has an outer ring that defines an inner opening of substantially ten inches in diameter and five inches in radius. The cross sectional diameter of the outer ring and the grip is substantially three-quarters and inch. The weight has a circumference at an inside radius of two feet and seven and one-half inches.

The largest exercise ring or weight has an outer ring that defines an inner opening having a diameter of one foot and a radius of six inches. This weight has a circumference at an inside radius of three feet and one and three-quarter inches. The cross section of the outer ring is substantially seven-eights of an inch. The cross section of the grip is substantially three-quarters of an inch.

As can be understood by viewing FIGS. 2A-2B, the various sized exercise rings may be arranged with the largest diameter on the bottom and in successively smaller diameters arranged atop one another. In this manner, the grip 5 of the smallest exercise ring may be grasped and removed from the system 10.

Figure 3B:
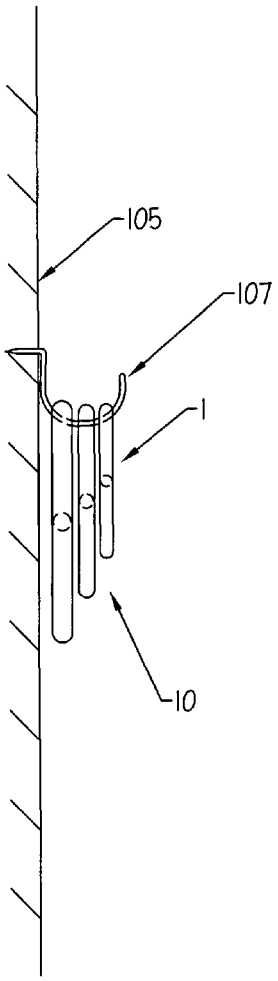
FIG. 3B shows a side view of the system of exercise rings being hung on the wall.
Figure 3A:
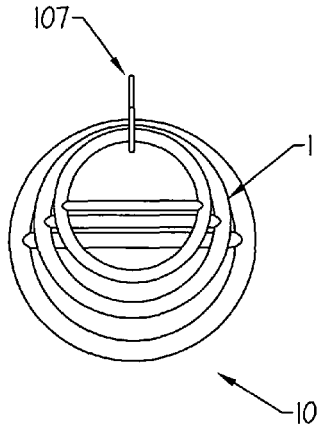
FIG. 3A shows a system of exercise weights comprising a plurality of exercise rings stored in a stacked pile and hung from a hook on a wall.

FIGS. 3A and 3B show a system of exercise rings 10 comprising a plurality of weighted exercise rings 1 that are stored in a stacked pile and hung from a hook 107 on the wall 105. As can be understood from the drawings, a hook 107 may be fastened to the wall 105 in a known manner. Thereafter, the outer rings of each weight may be deposited atop the hook 107. The system of weighs 10 is preferably arranged with the largest diameter arranged next to the wall 105 and each successively smaller diameter arranged away from the wall 105. In this manner, the lower side of the outer ring, as shown in FIG. 3B, creates a stepwise shape.

Figure 4A:
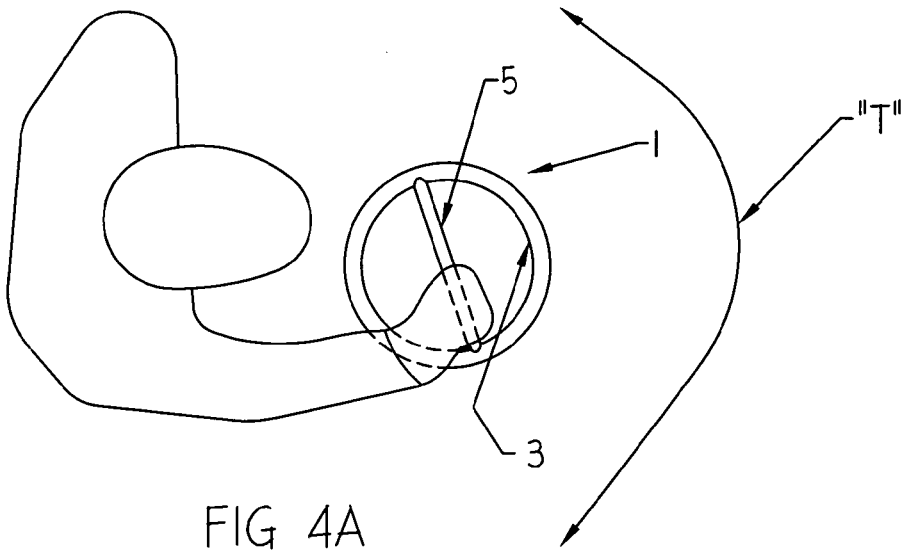
FIG. 4A is an overhead view of a first single grip that may be used in gripping the handle of the exercise ring or weight near the outer ring.
Figure 4B:
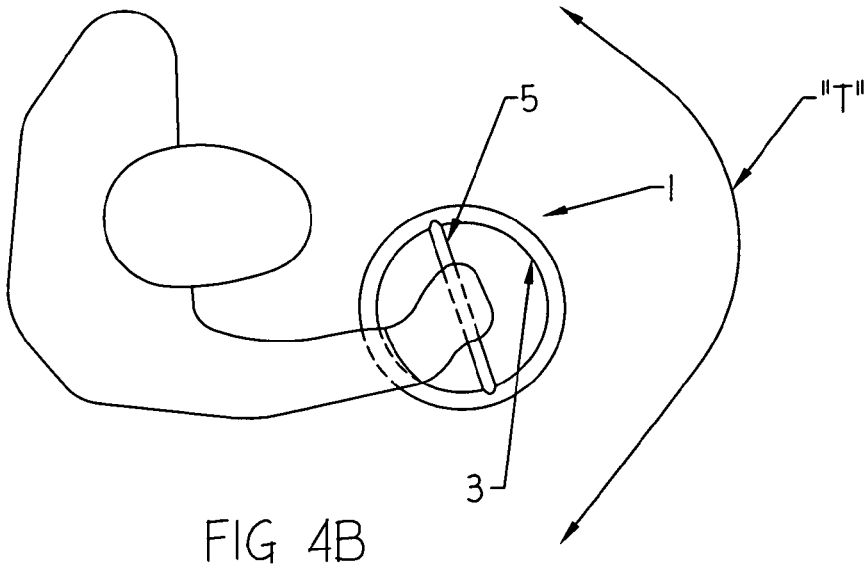
FIG. 4B is an overhead view of a second single grip that may be used in gripping the exercise ring or weight in the center of the handle thereof. In these figures, the handle is arranged perpendicular to the arm of the user.

FIGS. 4A and 4B are views of single hand grips that may be used in gripping the exercise ring. The user may perform exercises of the torso or shoulder by holding the weighted exercise ring away from the body and twisting to the left and right at the waist or shoulder. In this manner, the exercise ring is traversed to the right and left in front of the user. In FIG. 4A, the user grasps a weight 1 via the grip 5 near where it intersects the outer ring 3. As can be understood, this grip creates a downward moment about the user's wrist such that the weighted exercise ring is offset the left. This moment tends to move in a counter clockwise direction about the user's wrist when the exercise ring is held in the right hand as shown. However, the moment may be reversed by sliding the hand to the left side of the grip. In this instance a moment of inertia having a clockwise direction is created. When the exercise ring is held in the left hand, the inverse moments of the right hand are created. When the left hand grips the weight at or nearer the leftmost intersection between the outer ring and the grip, a clockwise moment is created. When a left hand grip is employed on the rightmost intersection, a counter clockwise moment is created. In FIG. 4B, a right hand grip is employed substantially near the center of the grip between the intersections to balance the exercise ring such that no moment of inertia is created. This type of grip is useful when elevated the weight. It should be noted that while both FIGS. 4A and 4B depict the wrist of the user passing across the outer ring, the weight and system are also useful to arthritic pain sufferers, or others who may experience problems associated with gripping the weight, when the outer ring is rested on the wrist of the user. In any event, various exercises may be performed by flexing different muscles of the body or turning the weight in a twisting motion.

Figure 5A:
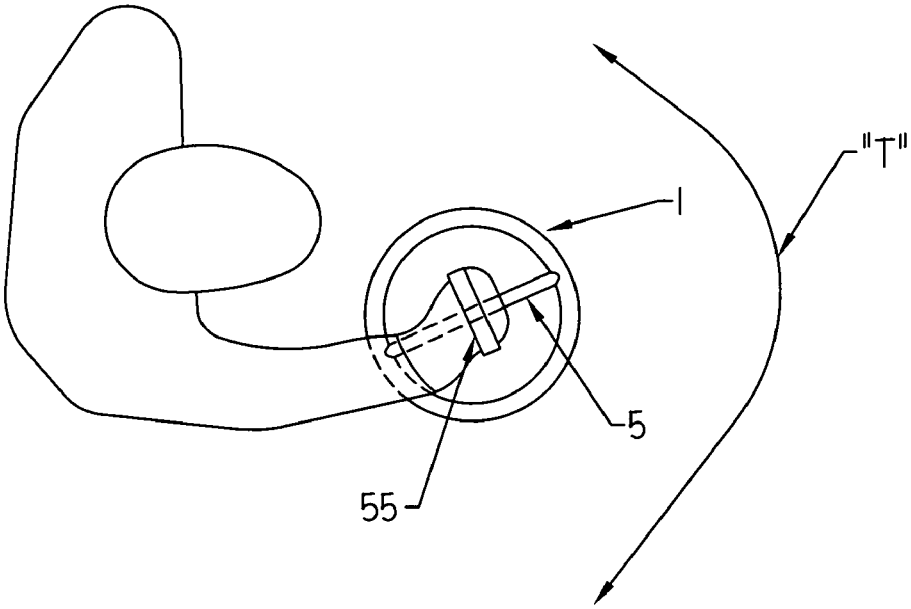
FIG. 5A is an overhead view of the exercise ring or weight strapped to a hand of a user who may experience difficulty in gripping it.
Figure 5B:
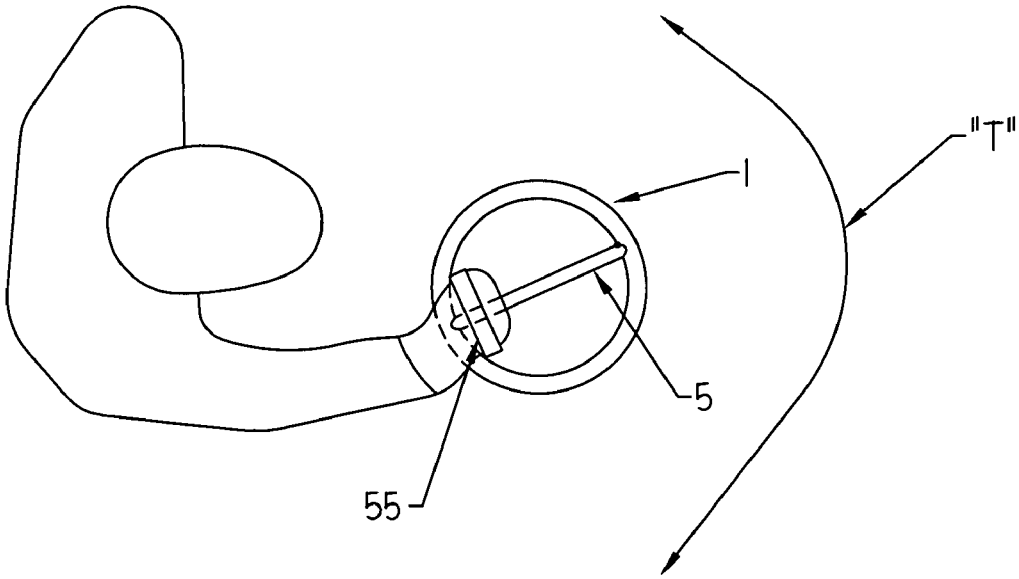
FIG. 5B is a side view showing a hand of a user extending through the exercise ring or weight at that region of the outer ring intersected by the grip. In these figures, the handle is arranged parallel to the arm.

FIGS. 5A and 5B are views of the weight strapped to a hand of a user who experiences difficulty in gripping the weight. As can be understood in FIG. 5A, a strap 55 couples the user's hand across the grip 5, such that the grip 5 is planar and parallel to the user's arm. The exercise ring is traversed as indicated by line "T". In FIG. 5B, the hand is strapped to the grip 5 substantially near one end of the grip near the outer ring.

Figure 6A:
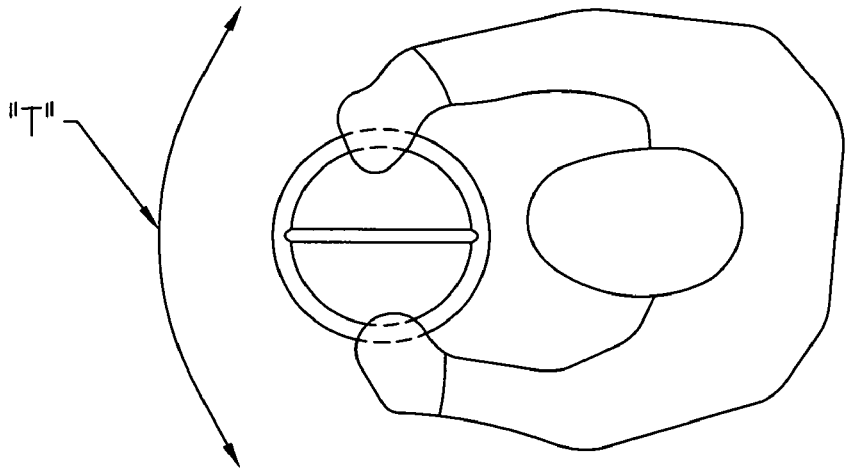
FIG. 6A shows an overhead view of first two-hand grip for using the exercise ring weight and an exercise that is performed by twisting the upper body at the waist.
Figure 6B:
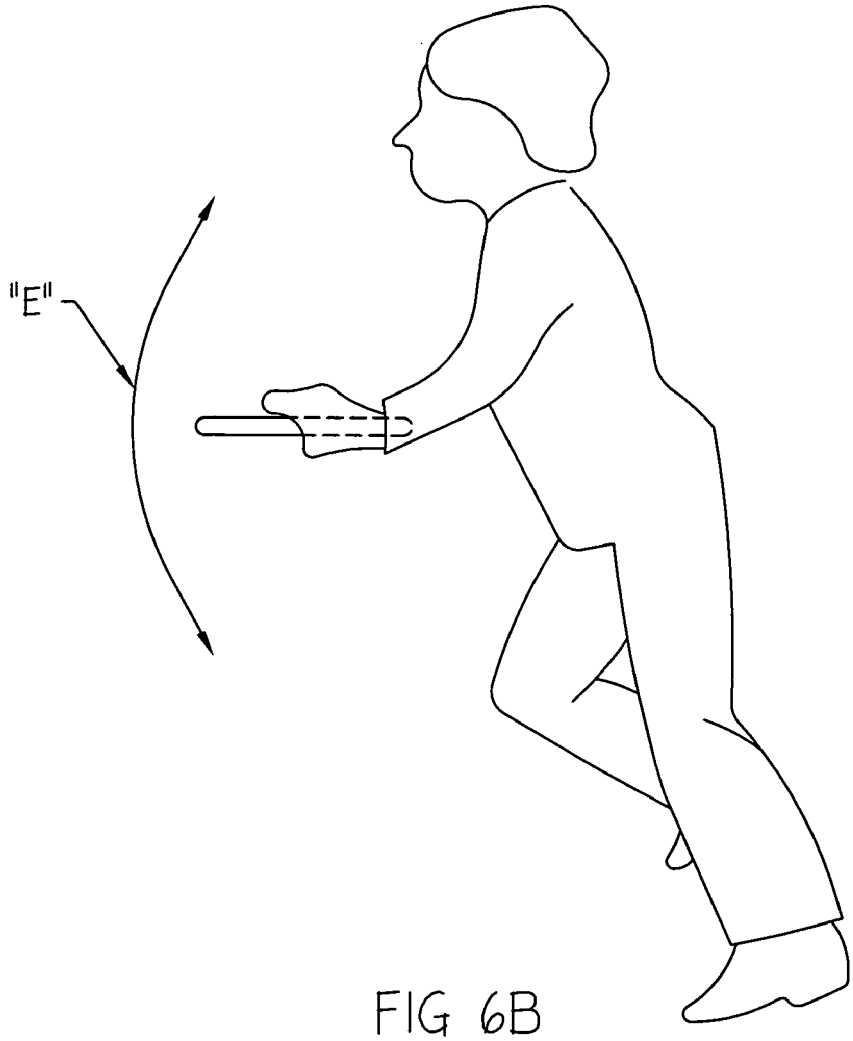
FIG. 6B shows a side view of the grip shown in FIG. 6A and a second exercise that may be performed by bending at the waist.

FIGS. 6A and 6B show views of a first two hand grip for using the exercise ring. In this instance, the exercise ring 1 or system 10 is held between the hands of the user away from the body by grasping the outer ring on either side of the grip. The grip is arranged substantially parallel to the arms of the user. The upper torso may be rotated in a clockwise or counter clockwise fashion relative to the legs to traverse the exercise ring left and right. This may be achieved when the user is either seated or standing. As shown in FIG. 6B, the exercise ring may be elevated as indicated by arrows "E". The exercise ring or system is raised or lowered with the hands of the user to strengthen arm muscles. Otherwise, squats may be performed with the weight maintained away from the body to strengthen the leg muscles. It should be noted that these figures show the hands arranged above the weight. However, this grip may be reversed such that the hands are arranged beneath the weight and facing upward. By varying the grip, while performing the different exercises, different muscle groups are worked.

Figure 6C:
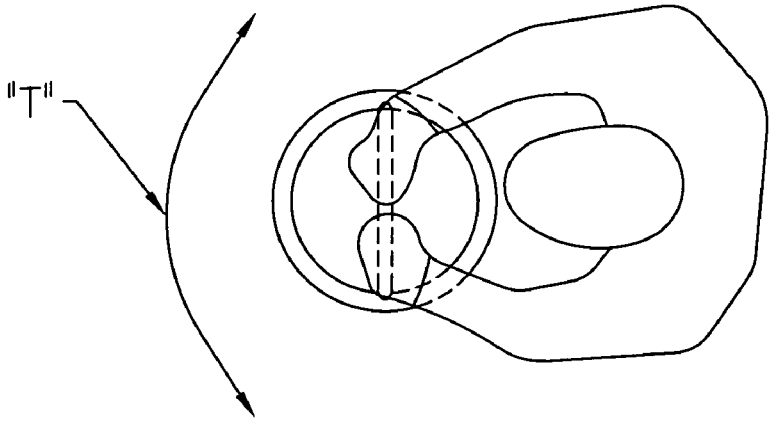
FIG. 6C shows an overhead view of a second two-hand grip for using the weight. In this instance, the handle is gripped by both hands.
Figure 6D:
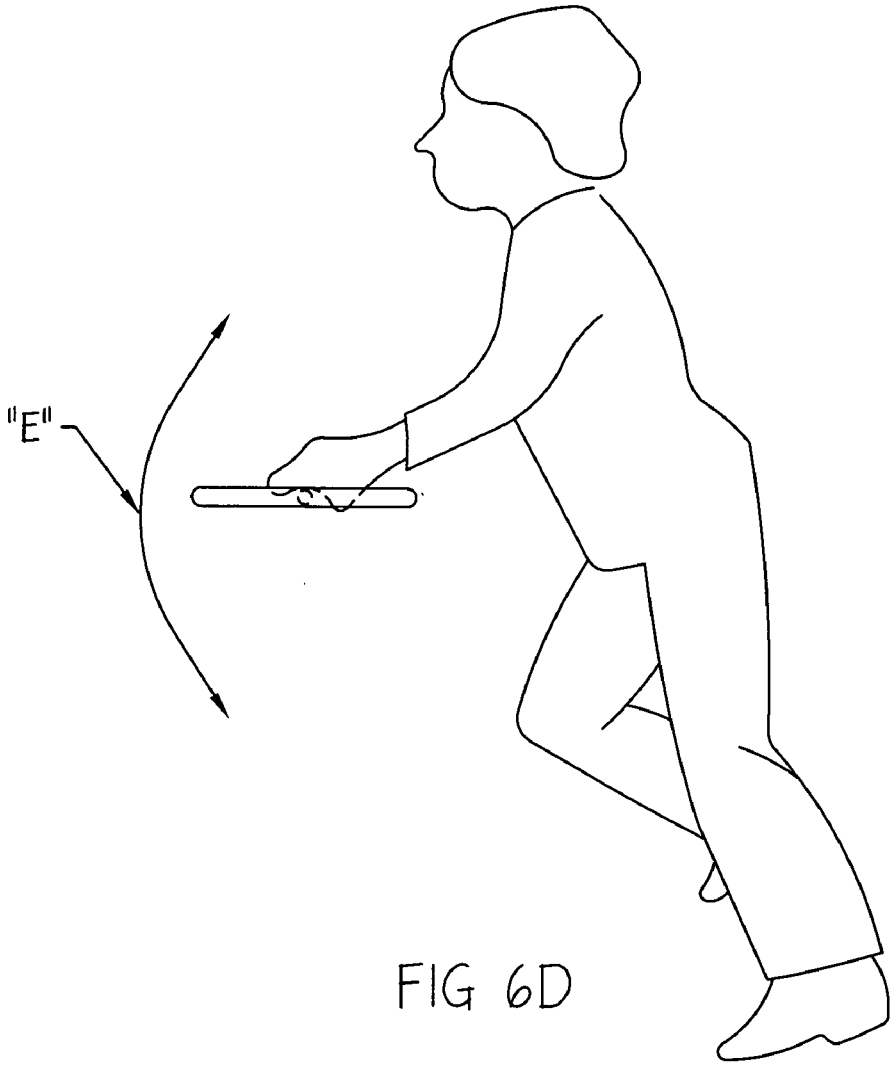
FIG. 6D shows a side view of FIG. 6C and the bending exercise as shown in FIG. 6B.

FIGS. 6C and 6D show views of a second two hand grip for using the weight. The hands are arranged with the palms facing downward and gripping the grip, as shown. The weighted exercise ring may be held away from the body while the upper torso is rotated in a clockwise or counter clockwise fashion relative to the legs, as mentioned above. Likewise, the other various exercises mentioned above may be performed.

Figure 7A:
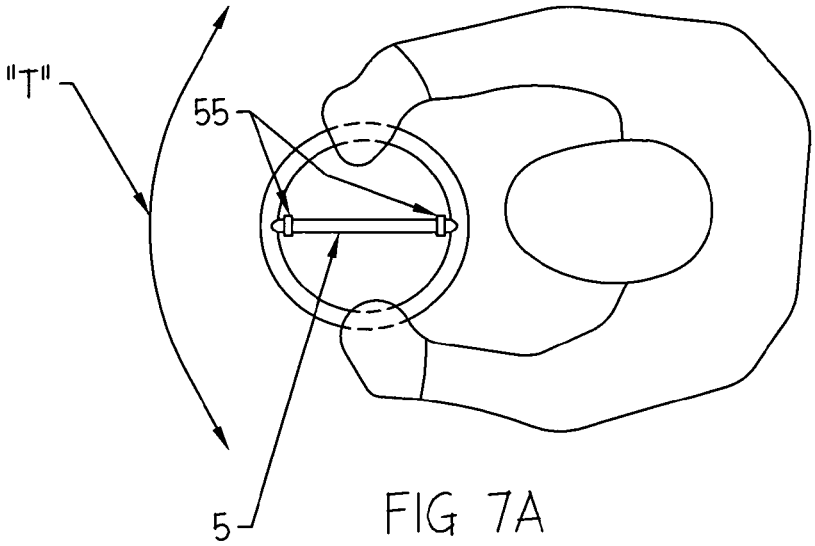
FIG. 7A is an overhead view of a two-hand grip used in performing exercises with the system of exercise rings or weights and showing a first exercise that may be performed with the system of weights.
Figure 7B:
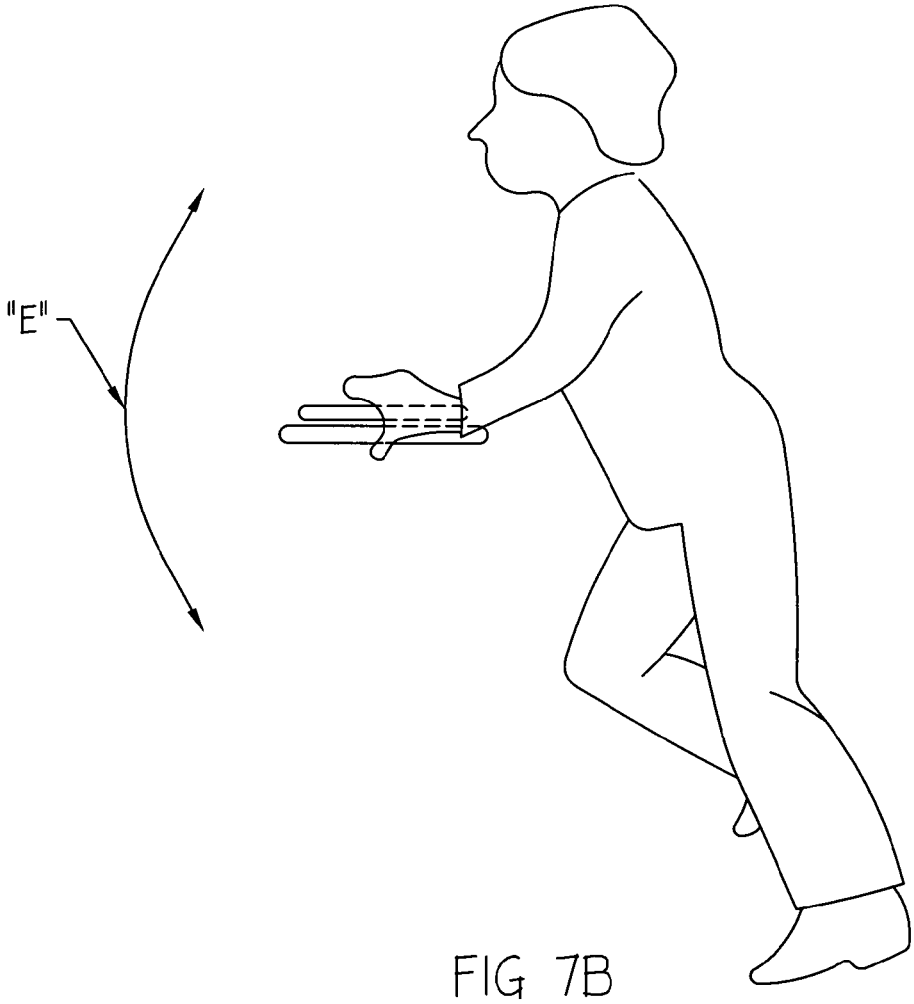
FIG. 7B is a side view of the FIG. 7A and showing a second exercise that may be performed with the two-hand grip.

FIGS. 7A and 7B show a two hand grip used in performing exercises with the system of the weights that are bound together by a pair of fasteners 55 arranged at opposite ends of grip 5. The various exercises mentioned above may be performed using this grip. In this instance, a pair of strap fasteners 55 are arranged at opposite ends of the grips 5 that couple the rings together.

Figure 8A:
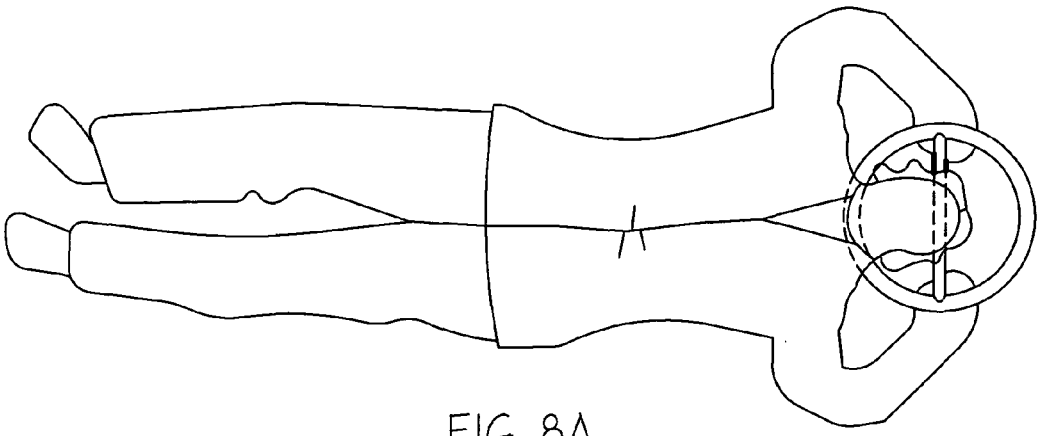
FIG. 8A is an overhead view of a first abdominal exercise that may be performed with the weight or system.
Figure 8B:
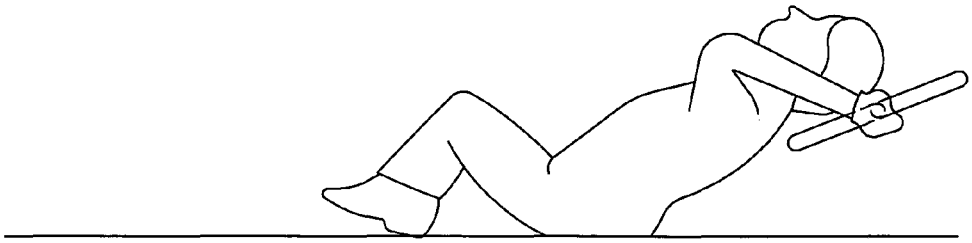
FIG. 8B is a side view of FIG. 8A.

FIGS. 8A and 8B are views of a first abdominal exercise that may be performed with the weighted exercise ring or system. As shown in a first abdominal exercise, the user arranges the device such that her head rests on the grip. Hands are arranged beneath the weight with palms facing upward. A sit-up is then performed to work the various legs, arms, chest, and abdominal muscles.

Figure 8C:
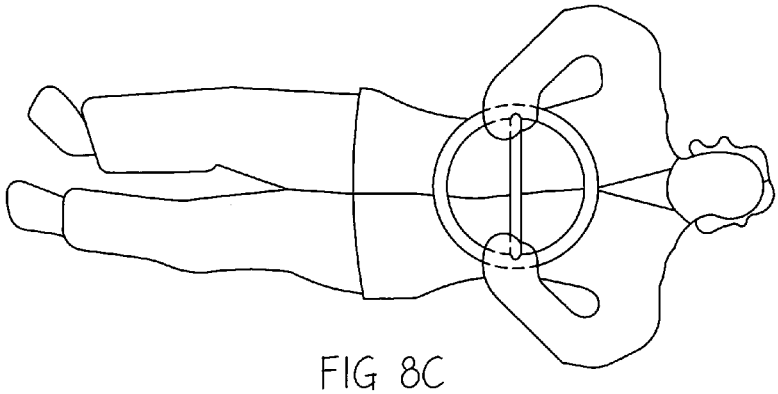
FIG. 8C is an overhead view of a second abdominal exercise that may be performed with the weight or system.
Figure 8D:
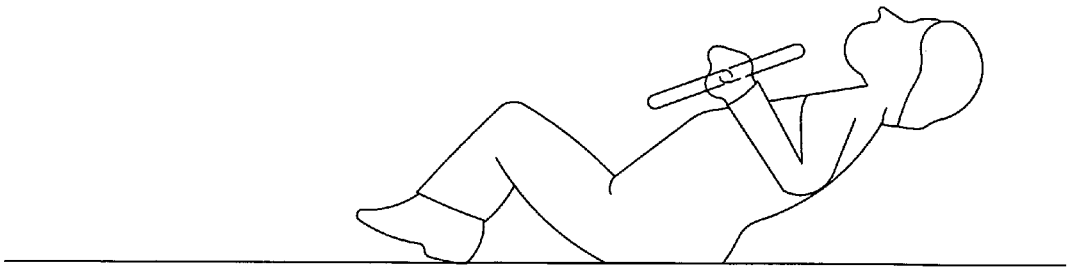
FIG. 8D is a side view of FIG. 8C.

FIGS. 8C and 8D are views of a second abdominal exercise that may be performed with the weighted exercise ring or system. In this exercise, the weighted exercise ring is arranged atop the user's chest while performing crunches or sit-ups.

Figure 9A:
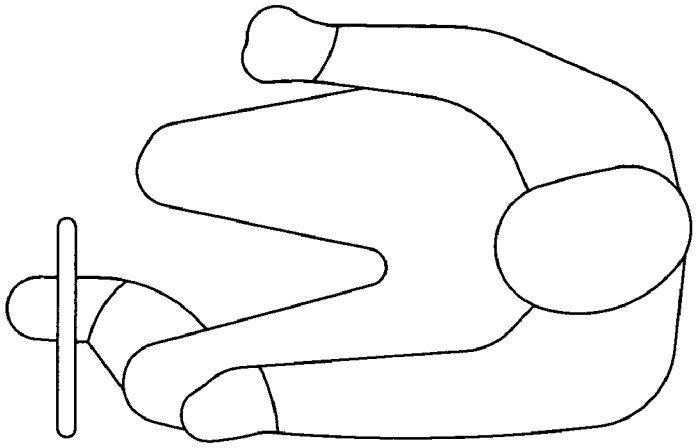
FIG. 9A is an overhead view of a first single leg exercise that may be performed with the weight and system.
Figure 9B:
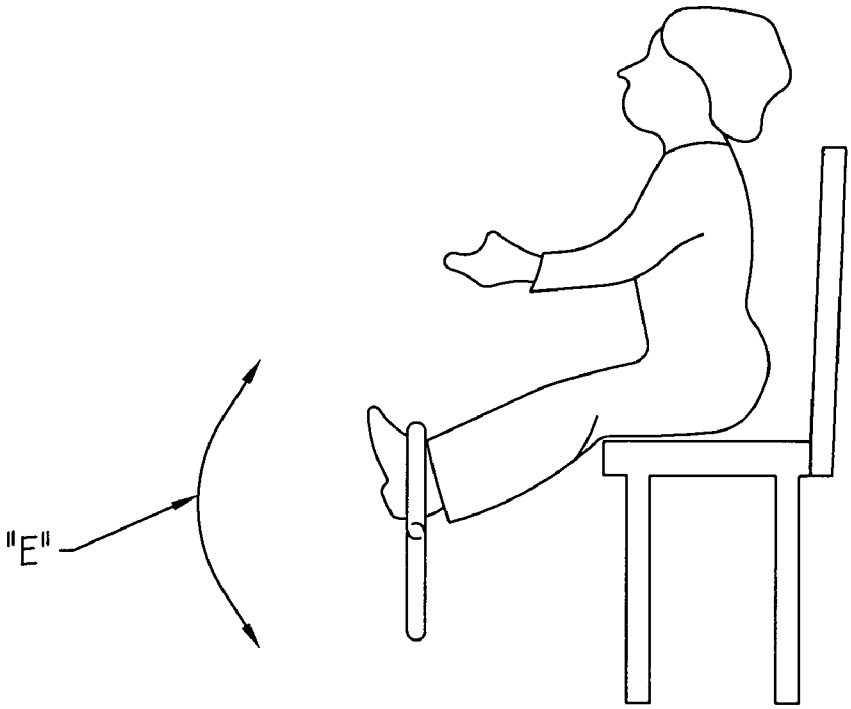
FIG. 9B is a side view of FIG. 9A.

FIGS. 9A and 9B are views of a first single leg exercise that may be performed with the weight and system. In this instance, the user is seated with legs bent. She passes her foot through either opening arranged on opposite sides of the grip. A portion of the outer ring is supported on the ankle such that the grip is parallel to the floor. The user then straightens her leg to lift the weight from the floor.

Figure 9C:
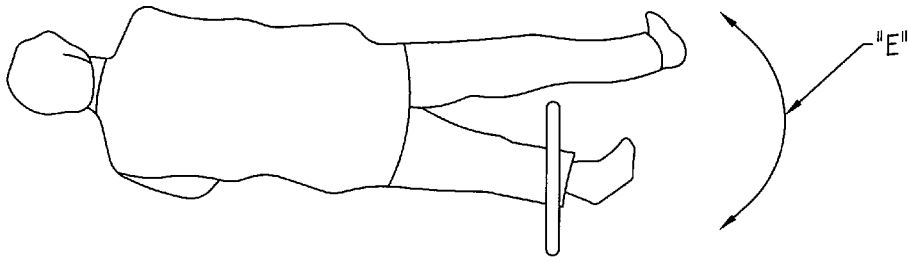
FIG. 9C is a side view of a second single leg exercise that may be performed with the weight system.
Figure 9D:
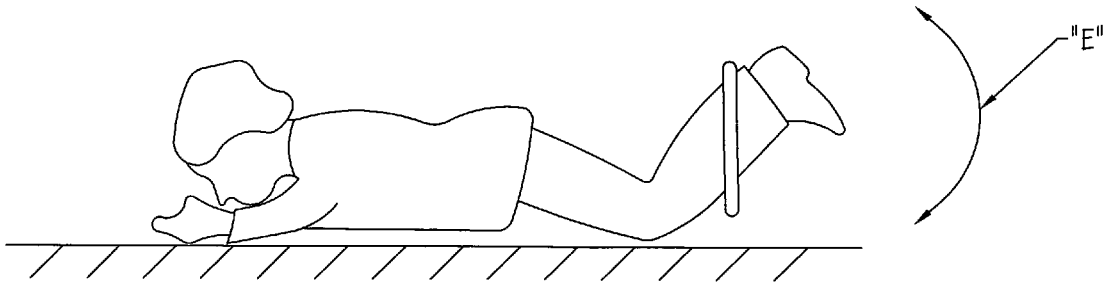
FIG. 9D is a side view of a third single leg exercise that may be performed with the weight system.
Figure 10A:
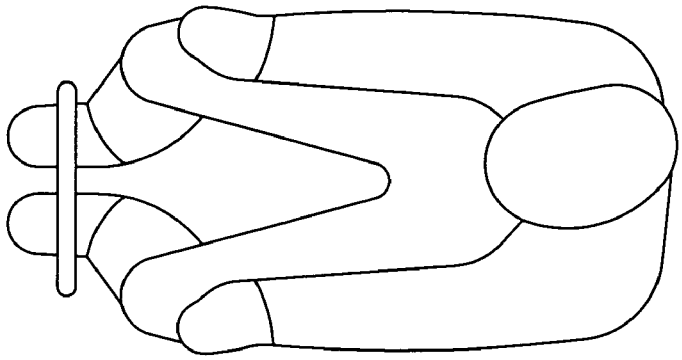
FIG. 10A is an overhead view of a first dual leg exercise that may be performed with the weight and system.
Figure 10B:
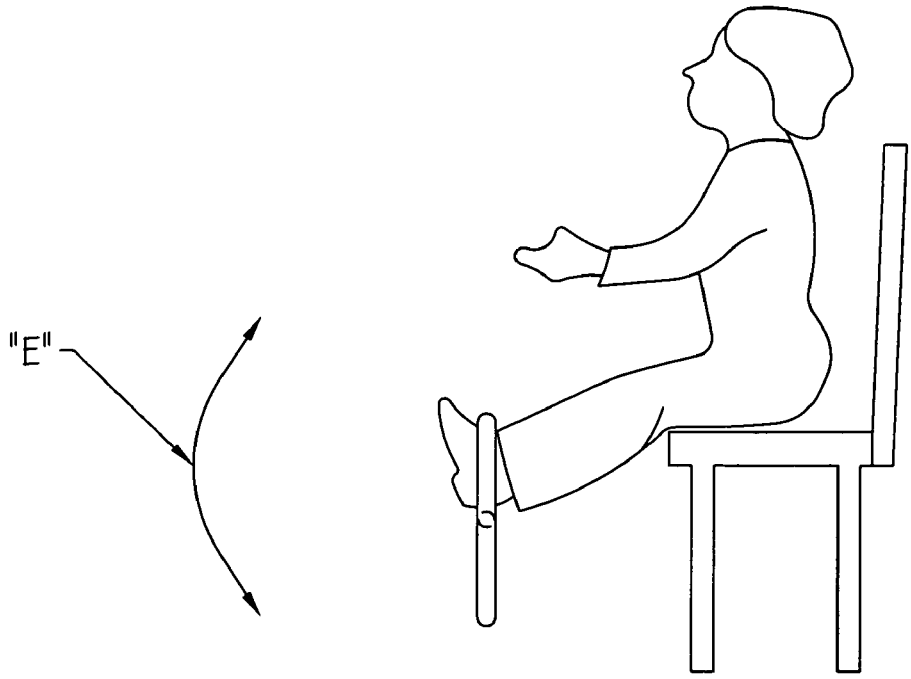
FIG. 10B is a side view of FIG. 10A.

FIGS. 9C and 9D are views of a second single leg exercise that may be performed with the weight and system. In FIG. 9C, a user lies on her side with the upper foot ahead of her and the lower foot passed through the internal opening of the outer ring. The lower leg is then raised upward. In FIG. 9D, the user lies face down in a prone position with a weight arranged about an ankle FIGS. 10A and 10B are views of a first dual leg exercise that may be performed with the weight and system. In this instance, the feet of the user are passed through a respective opening in the exercise ring on either side of the grip. The user then performs exercises similar to those described above with respect to FIGS. 9A and 9B.

Figure 10C:
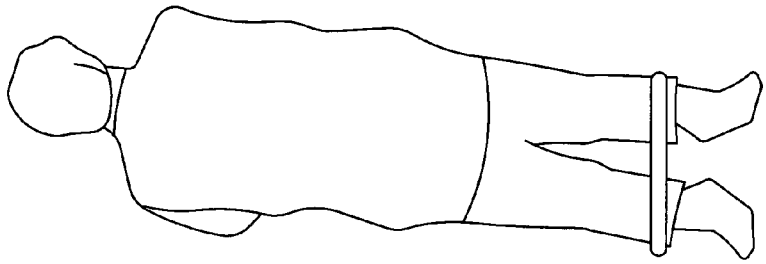
FIG. 10C is a side view of a second dual leg exercise that may be performed with the weight and system.
Figure 10D:
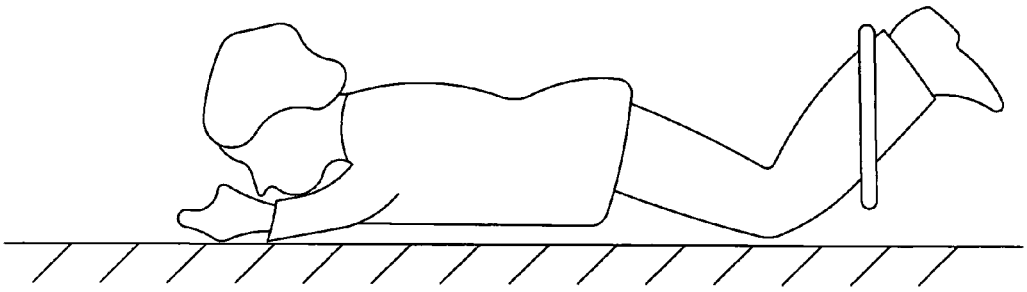
FIG. 10D is a side view of a third dual leg exercise.

FIGS. 10C and 10D are views of a second dual leg exercise that may be performed with the weight and system. In this instance the user lies face down in a prone position with a weight arranged about both ankles. The knees of the user are then bent as shown in FIG. 10D to work the muscles on the back side of the leg.

Figure 11A:
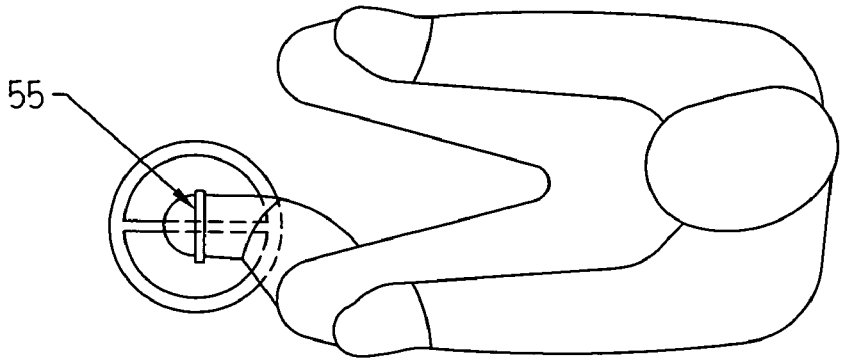
FIGS. 11A and 11B show the weight strapped to the foot of a user for use in performing leg lifts.
Figure 11B:
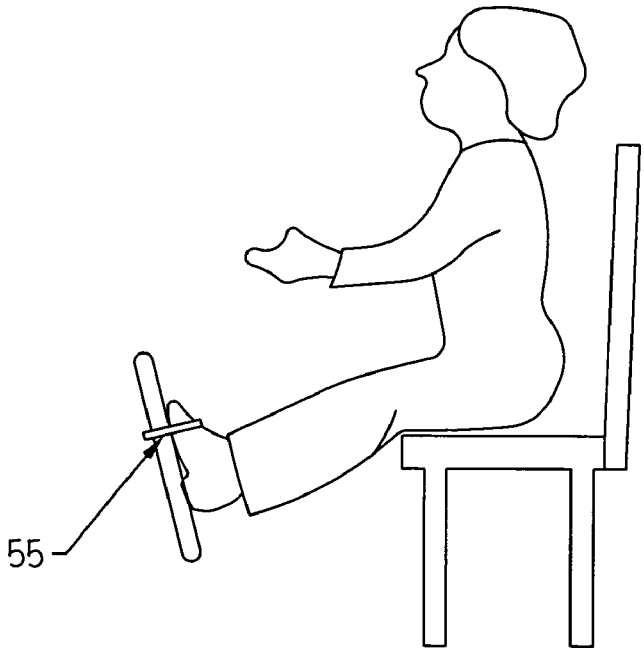

FIGS. 11A and 11B show the weight strapped to the foot of a user for performing leg lifts. In this instance, the user arranges one foot atop the grip and straps the weight to an underside of the foot via fastener 55 while sitting in a seat. The fastener 55 may comprise any strap having a large enough tensile strength support the weight from the foot. It may comprise heavy duty hook and loop fastening material that fastens about itself. The legs are straightened as shown in FIG. 11B to work the front of the legs.

The terms "upper" and "lower" define the relationship of two or more weights when stacked atop one another. The term "larger" may include the mass of a weight as well as a larger cross section of the handle and/or outer ring. The present invention is a system of weights that includes a plurality of sizes in mass, diameter, and cross sectional dimensions. The handle and outer ring are formed as a circle when taken in cross section. The weights include a handle which may be grasped during use and that may be used to couple the different weights to one another. The different sized weights may be fastened together by one of either the handle and/or the outer ring such that the outer ring of a succeeding weight stacked atop a lower positioned weight, the lower positioned weight typically being a larger weight in size and mass, may be extended beyond the outer ring of the lower positioned weight to create a larger weight. This uneven loading beneficially shifts the center of mass and creates a variety of moments of inertia for working different areas of the body. The system of weights can be configured to create various sized moments which are exerted onto different muscle groups, joints, and other tissues by arranging different weights in a variety of asymmetrical and symmetrical manners. Thus, the weights may be arranged in a symmetrical manner where a succeeding weight is balanced and fastened atop the handle in the center of the outer ring of the lower weight. Or, the weights may be arranged in an asymmetrical manner where the outer ring of a succeeding weight is arranged either atop the outer ring of the lower weight or outside of the outer ring of the lower weight.

Figure 12A:
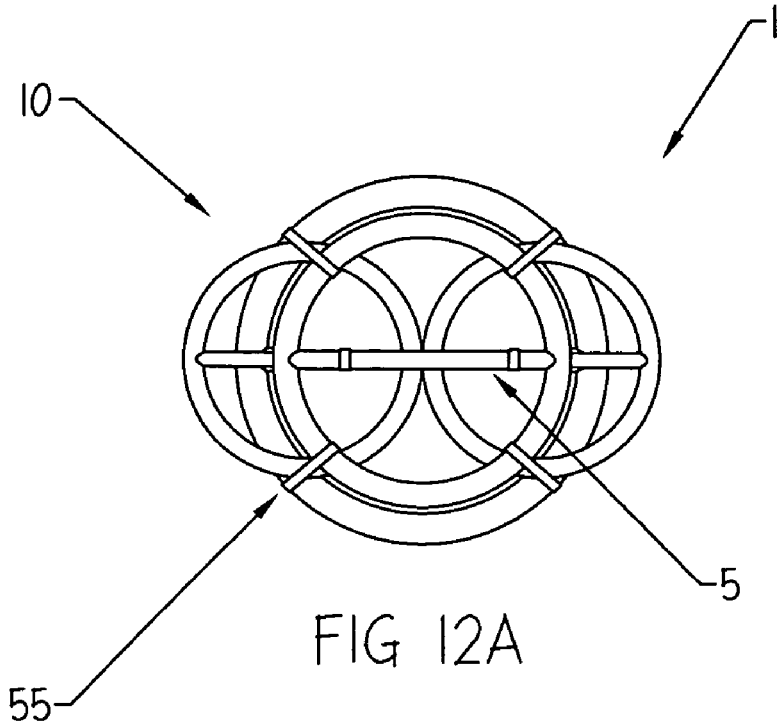
FIG. 12A is an overhead view showing a plurality of weights configured into a single heavier weight.
Figure 12B:
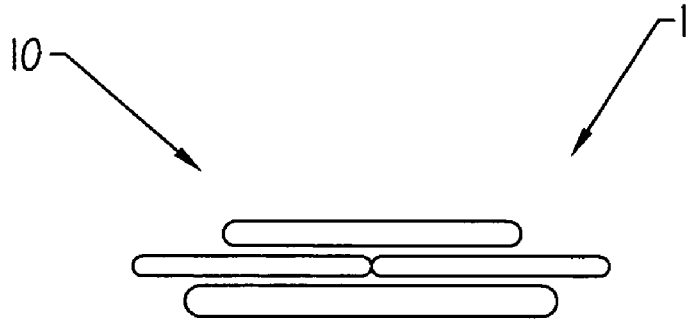
FIG. 12B is a side view of the weights shown in FIG. 12A.

FIGS. 12A-12B shows a symmetrical arrangement of four stacked weights. In this instance, the largest weight is arranged at a bottom of the stack of weights. Next, a pair of weights, preferably of the same denomination, is arranged atop the largest weight such that a portion of each extends outward beyond the outer ring of the largest weight. A medium sized weight is arranged atop the pair of weights such that the outer ring of the medium weight is within a plane extended upwards from the outer ring of the bottom weight. Fasteners may be provided where each of the rings of the weights overlaps one another as shown. Portions of the handles are arranged atop one another and fastened together via strip fasteners as shown.

Figure 13A:
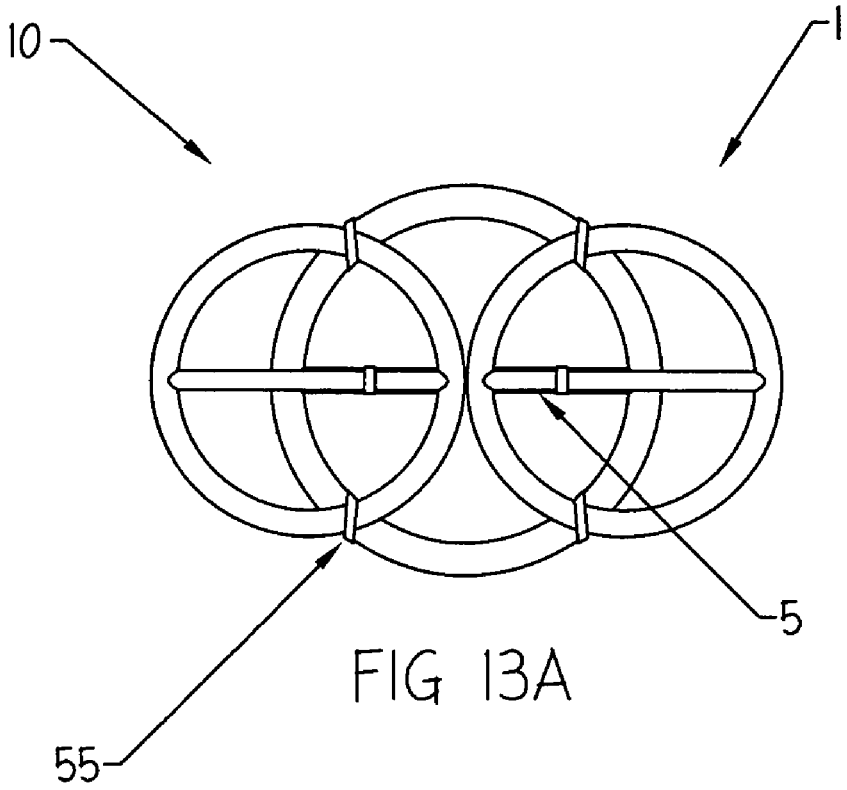
FIG. 13A is an overhead view showing a different configuration of the weights.
Figure 13B:
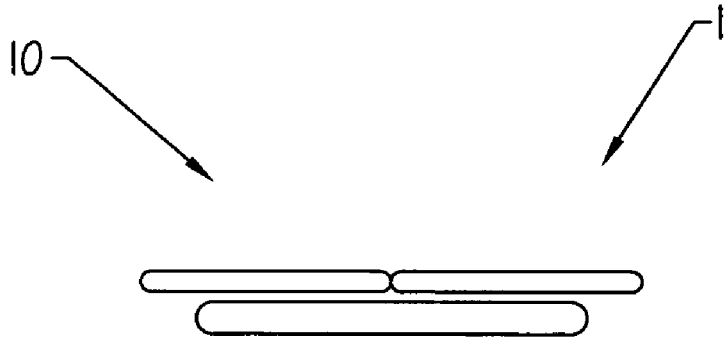
FIG. 13B is a side view of the configuration shown in FIG. 13A.

FIGS. 13A-13B show a symmetrical arrangement of three stacked weights. The weight system is unbalanced with respect to the center of the weights. In this instance, the largest weight is arranged beneath the two smaller weights which are placed side-by-side such that a portion of each handle rests atop the handle of the larger, bottom weight. Strip fasteners secure the handles of the smaller weights to the handle of the larger weight. Strip fasteners are also included where the outer rings of the smaller weights pass across the outer ring of the bottom weight.

Figure 14A:
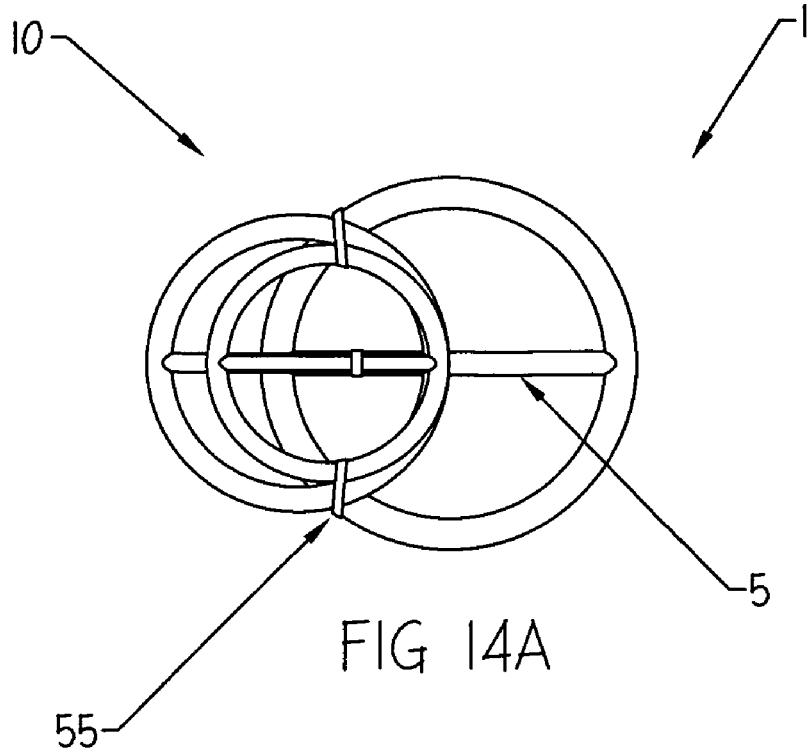
FIG. 14A is an overhead view showing a further configuration of the weights.
Figure 14B:
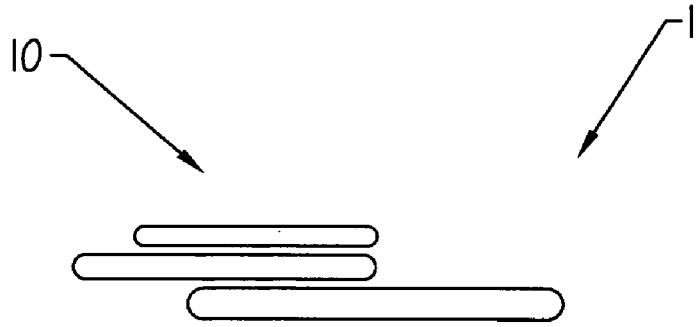
FIG. 14B is a side view of FIG. 14A.

FIGS. 14A-14B show an unbalanced, asymmetrical configuration of three weights. In this instance, a medium sized weight is arranged atop a larger weight. A smaller weight is arranged atop the medium sized weight. A portion of the outer rings of the smaller two weights are positioned outside of the plane extending upward from the outer ring of the largest weight. The handles of the three weights are coupled together via strip fasteners. Strip fasteners tie the weight system together where the outer rings of the smaller two weights overlap one another and the outer ring of the largest weight. As can be recognized by FIG. 14B, substantially one-half of the middle weight is arranged outside of the plane extending upwards from the outer ring of the bottom weight.

Figure 15A:
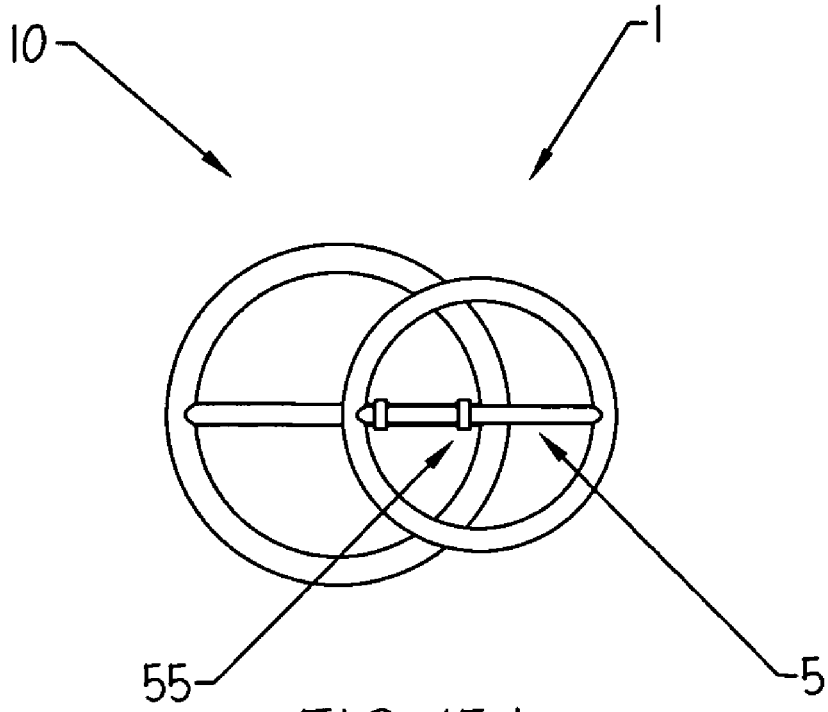
FIG. 15A is an overhead view showing a pair of weights from the system coupled together.
Figure 15B:
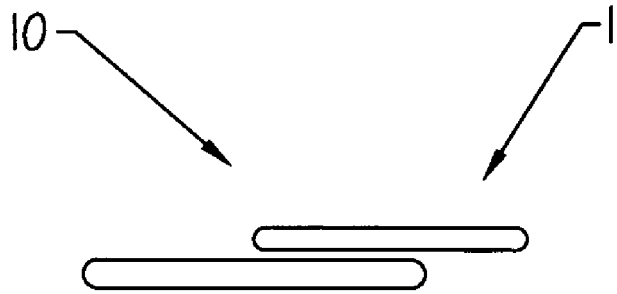
FIG. 15B is a side view of FIG. 15A.

FIGS. 15A-15 show an asymmetrical arrangement of two weights. The smaller weight is arranged and fastened above the larger weight. A pair of strip fasteners secure the handles of the two weights together. One strip fastener is arranged substantially near the outer ring of the smaller weight whilst the other strip fastener is arranged substantially near the outer ring of the larger weight. It should be noted that the strip fasteners may be fastened to either the overlapping handles or outer rings of the weights.

As previously described, the invention is a weighted exercise ring that may be used autonomously or together as a system of weights. While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A system of weighted exercise rings comprising:

a first weighted exercise ring having an outer ring that defines an interior opening and a handle fixed to outer ring and bisecting the interior opening to divide the outer ring into symmetrical halves, said outer ring having a circular cross section;

a second weighted exercise ring having an outer ring that defines an interior opening and a handle fixed to the outer ring in the interior opening to bisect the outer ring of the second weighted exercise ring into symmetrical halves, said outer ring of the second weighted exercise ring having a circular cross section and a smaller interior opening than the interior opening of the first weighted exercise ring; and, a third weighted exercise ring having an outer ring that defines an interior opening and a handle fixed to the outer ring in the interior opening to bisect the outer ring of the third weight into symmetrical halves, said outer ring of the third weighted exercise ring having a circular cross section and a smaller interior opening than the interior openings of the first and second weighted exercise rings; and a coupling means that couples one of the handles and outer rings of the first, second, and third weighted exercise rings together such that the handles of the first, second, and third weighted exercise rings overlap one another, wherein a first configuration of said system of weighted exercise rings is balanced, symmetrical and has the second and third exercise rings arranged atop the first exercise ring such that the outer rings of the second and third exercise rings are arranged within a plane extending upwards from the outer ring of the first exercise ring with the handles stacked atop one another, and wherein a second configuration of said system of weighted exercise rings is balanced, asymmetrical and has the second and third exercise rings arranged atop the first exercise ring such that portions of the outer rings of the second and third exercise rings are arranged outside of the plane extending upwards from the outer ring of the first exercise ring.

2. The system of weighted exercise rings of claim 1 wherein said outer rings have one of a plastic and rubber coating thereon.

3. The system of weighted exercise rings of claim 1 wherein said outer rings have chrome plating thereon.

4. The system of weighted exercise rings of claim 1 wherein the outer rings comprise a rigid plastic shell filled with sand.

5. The system weighted exercise rings of claim 1 wherein said outer rings each comprise a rigid plastic shell filled with liquid and further include an opening to an interior of the plastic shell and a cover that seals said opening.

6. The system of weighted exercise rings of claim 5 wherein said liquid is water.

7. The system of weighted exercise rings of claim 1 wherein said outer rings are formed in the shape of one or more selected from a group consisting of a circle and an oval.

8. The system of weighted exercise rings of claim 1 wherein the outer rings comprise iron.

9. The system of weighted exercise rings of claim 1 wherein said outer rings are hollow and filled with one or more materials selected from a group consisting of sand, shot, and water.

10. The system of exercise rings of claim 1 further comprising outer rings that define interior openings having diameters in a range of between six and twelve inches.

11. The system of exercise rings of claim 1 wherein said coupling means includes a strip of hook and loop material.

* * * * *